United States Patent [19]

Knapp et al.

[11] Patent Number: 4,678,023

[45] Date of Patent: Jul. 7, 1987

[54] CLOSED LOOP DELIVERY GAUGE CONTROL IN ROLL CASTING

[75] Inventors: David J. Knapp, Monroeville; Marion D. Waltz, Tarentum, both of Pa.

[73] Assignee: Aluminum Company of America, Pittsburgh, Pa.

[21] Appl. No.: 812,996

[22] Filed: Dec. 24, 1985

[51] Int. Cl.[4] ..... B22D 11/16

[52] U.S. Cl. ..... 164/452; 164/454; 164/455; 164/480

[58] Field of Search ..... 164/413, 428, 451, 452, 164/453, 454, 480, 455

[56] References Cited

U.S. PATENT DOCUMENTS

| | | | |
|---|---|---|---|
| 4,222,254 | 9/1980 | King, Jr. et al. | 72/8 |
| 4,497,360 | 2/1985 | Bercovici | 164/454 |
| 4,546,814 | 10/1985 | Shibuya et al. | 164/480 |

FOREIGN PATENT DOCUMENTS

| | | | |
|---|---|---|---|
| 58-23543 | 2/1983 | Japan | 164/452 |
| 59-193740 | 11/1984 | Japan | 164/452 |

*Primary Examiner*—Nicholas P. Godici
*Assistant Examiner*—Richard K. Seidel
*Attorney, Agent, or Firm*—Elroy Strickland

[57] ABSTRACT

An integrated process for automatically controlling the position of solidification of molten metal in the bite of rotating rolls of roll casting apparatus, the gauge of solid metal exiting the apparatus, and compensation for eccentricity in the rolls of the apparatus. The process includes a series of measuring steps that provide values indicative of solidification position, exit gauge and the frequency of roll eccentricity. The solidification position and gauge values are separately compared to reference values established for the position and gauge, with corrections being made respectively to the speed and casting gap of the rolls when differences occur between the measured and reference values. While such measuring and correcting steps are being performed the measured frequency of eccentricity is being employed to cyclically change the roll gap to offset the effects of eccentricity on the gauge of metal exiting the mill.

9 Claims, 3 Drawing Figures

CLOSED LOOP DELIVERY GAUGE CONTROL IN ROLL CASTING

BACKGROUND OF THE INVENTION

Figure 1:
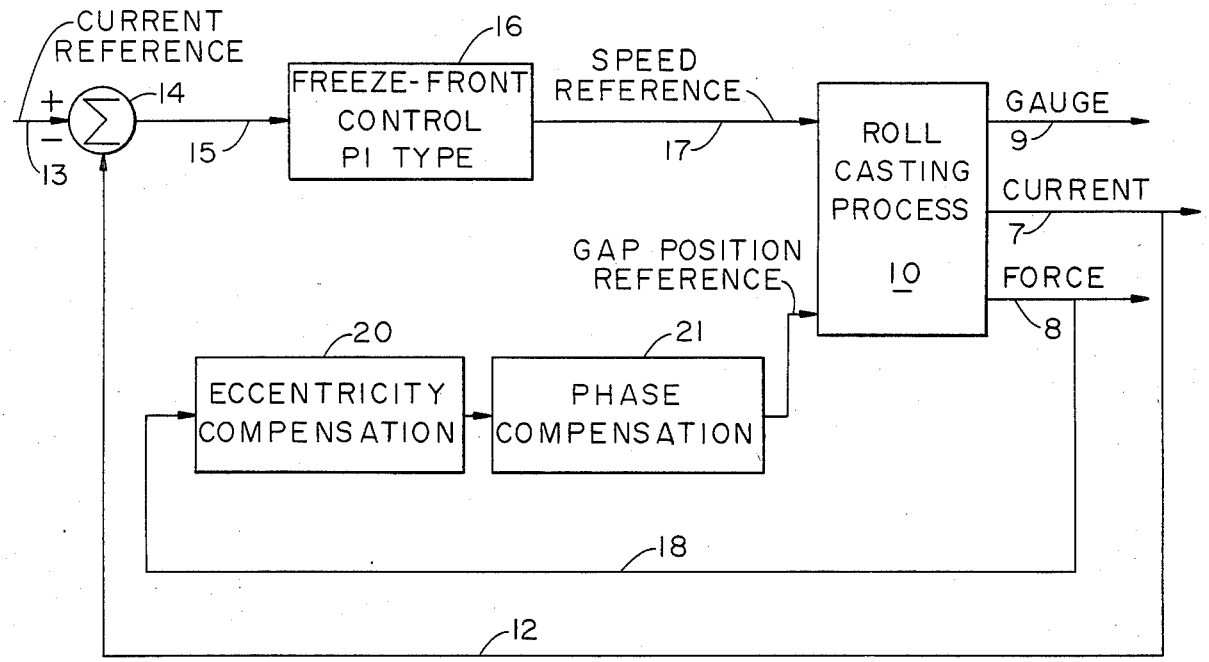

The present invention is directed generally to roll casting process control, and particularly to systems that generate necessary control actions to maintain differences between desired and actual process parameter values as near to zero as possible.

Heretofore there has not been a totally integrated automatic package for continuously precisely controlling the location of the freezing front of molten metal in the bite of casting rolls, the gauge of the metal exiting the rolls compensating for the eccentricity of the rolls, and combining and decoupling various automation schemes to yield such an integrated package.

For example, U.S. Pat. No. 4,497,360 to Bercovici discloses a method of optimizing productivity of a roll casting machine by measuring the torque exerted on at least one of the rolls, the stress on roll journals, or temperature of the strip exiting the machine. Deviations from a constantly computed previous average value of one or more of the above parameters are then used to control roll speed. If the deviation exceeds a reference deviation, the casting speed of the machine is reduced until the deviation becomes less than the reference deviation. Casting speed is then increased as long as the deviation remains lower than the reference.

Published European Patent Application No. 0,138,059 shows control of solidification time and position of the freezing front of metal in the bite of the rolls of a roll casting machine by measuring a rolling torque or rolling pressure and then controlling the rotational speed of the rolls as a function of torque or pressure.

BRIEF SUMMARY OF THE INVENTION

Freeze front position and exit strip gauge are very tightly coupled. This can be seen by considering the gaugemeter equation $$h(t) = \frac{\Delta F(t)}{M} + \Delta S(t) \tag{1}$$

where h is strip exit gauge, F is separating force, M is mill modulus, and S is the unloaded roll gap ("t" is employed to note the time varying character of the parameters). Equation (1) basically says that exit strip gauge is a sum of the unloaded roll gap plus mill stretch.

Separating force and roll gap are negatively coupled. If the gap (g) between the opposed rolls decreases, more work is performed in rolling the metal. This drives separating force (F) up, thereby increasing mill stretch and partially compensating for the original reduction in the roll gap. Conversely, if the roll gap were to increase, less work is required to roll the metal and separating force decreases, reducing mill stretch. If the casting process was not under any type of control, only a fraction of the roll gap disturbances would appear as exit gauge disturbances.

Freeze front control continuously adjusts line speed so that the freeze front remains in the same position; the amount of working performed on the metal remains constant. Thus, the mill stretch term in equation (1) can be approximated by a constant in a modification of equation (1) as follows:

$$\Delta h(t) = K + \Delta S(t) \tag{2}$$

If only freeze front control is employed, all of the roll gap variations appear in the exit gauge. Because of the coupling between freeze front and exit gauge, exit gauge is more strongly affected by roll gap disturbances if freeze front control is employed without dynamic roll gap control.

It is, therefore, a primary objective of the present invention to simultaneously provide eccentricity compensation and freeze front control to avoid accentuation of the eccentricity problem. This is accomplished by (1) separating eccentricity disturbances from the total freeze front disturbance, (2) utilizing the eccentricity disturbances to dynamically relieve rolling force and (3) performing freeze front regulation using only the remaining freeze front disturbance indication (signal).

An eccentricity compensation technique that can be employed in the present invention is disclosed in U.S. Pat. No. 4,222,254 to King et al. The disclosure of this patent is incorporated herein by reference.

A supervisory computer is employed to sum references for primary actuator controllers, as explained in detail hereinafter, that directly control the roll casting process.

THE DRAWINGS

Figure 2:
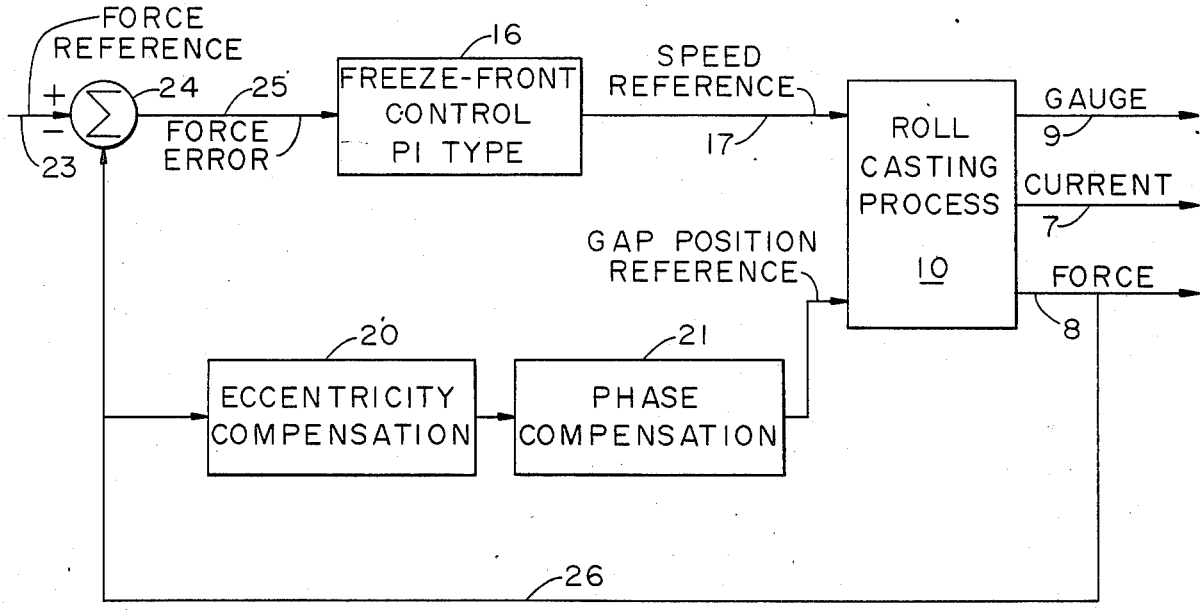
Figure 3:
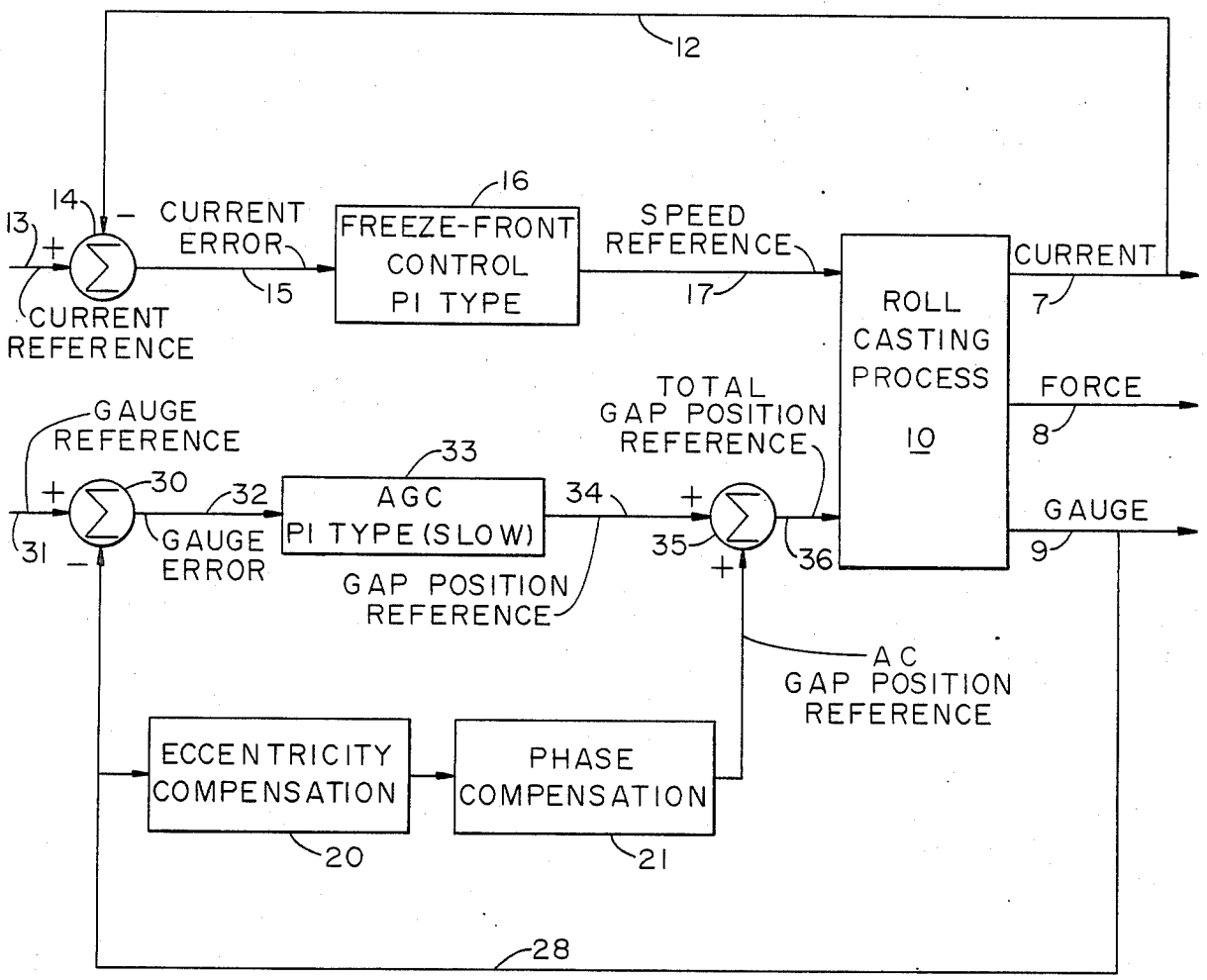

The objectives and advantages of the invention will be more apparent from consideration of the following detailed description and accompanying drawings in which:

FIG. 1 is a diagrammatic representation of one control method of the invention, wherein freeze front control is effected by measuring the current of the motor driving the rolls of roll casting apparatus while eccentricity compensation is provided by measuring roll force;

FIG. 2 is a diagrammatic representation similar to that of FIG. 1 except that rolling force is the measurement effecting both freeze front and eccentricity control; and FIG. 3 is a diagrammatic representation of a roll casting process in which the gauge of exiting metal is employed to effect eccentricity compensation and automatic gauge control while motor current measurement provides freeze front control; a parameter alternative to motor current for freeze front control would involve rolling force in a manner similar to that of FIG. 2.

PREFERRED EMBODIMENTS

Referring now to the drawings, FIG. 1 shows schematically a roll casting machine 10. The details of such machines are well known such that it is believed unnecessary to present details of the same in the drawings. The rolls of a roll casting machine are driven by the armature of a DC motor (not shown) in the casting process, and the size of a casting gap between opposed rolls is set by mechanical actuators such as jacks, screws, or fluid operable cylinders. In FIG. 1, the flow of electrical current 7 through the armature of the casting motor is measured, the value of this measurement being fed back to a summing junction 14, as indicated by line 12. It will be noted in FIG. 1 that two additional rolling parameters are shown, namely, the force 8 at which the casting rolls roll solid metal in the gap between the rolls, and the gauge 9 of the metal product issuing from the rolls. The use of these parameters will be discussed in detail hereinafter.

Junction 14, in addition, is provided with a current reference value 13 that has a polarity opposite to that representing armature current. The reference value is provided by a person operating the casting machine, which person inputs the reference to a digital computer, discussed in detail below, as a set point for control of motor current. A computer is used to sum the reference and measured current values.

Junction 14 provides an output 15 that is a value reflecting an error position of the freeze front. This error value is directed to a controller 16 that is preferably the standard proportional-integral (PI) type regulator that provides large, rapid corrections (proportional) for large parameter errors when sensed and then drives the remaining (integral) error to zero. Junction 14 sums, i.e., determines any difference that may occur between reference value 13 and that of the value 7 representing motor current. The freeze front controller 16 is thereby instructed to properly locate the freezing front of molten metal in the entry side of the bite of the casting rolls by adjusting the speed of the rolls. It does this by use of an algorithm that provides a speed reference at 17. Reference 17 maintains the freezing front of the molten metal in the bite of the casting rolls at the proper location.

Motor current value is affected by any change in the location of the freeze front, as such a change will affect the load that the motor sees and thus the amount of current drawn by the motor. For example, if the freeze front moves into the gap of the rolls, the rolls will be working on relatively soft metal such that less current will be needed by the motor to roll the metal to a chosen gauge. The opposite, of course, is true if freezing takes place at a too early position in the roll bite. Such a decrease or increase in motor current is sensed by an appropriate current sensing means (not shown) which develops the above-discussed value (signal) that is fed back to junction 14. (The current sensing means is an analogue device and the computer a digital device. Because of this, the value of motor current fed back to junction 14 is converted to a digital indication of motor current. This, in addition, will be true for other parameters that are measured and fed back for control purposes in the processes of the present invention. All of the processing operations in the drawings are performed by a digital computer, not otherwise depicted in the figures.)

Freeze front control tends to amplify the eccentricity problem, as the control provides a constant rolling force (F) on the metal being rolled without relief of such force. As a consequence, the larger diameter of the eccentric roll or rolls moves into the metal in the gap between the rolls, thereby leaving relatively deep undulating impressions in the product exiting the rolls.

The present invention solves this problem by utilizing mechanical or hydraulic gap control actuators (not shown) on roll casters in a dynamic manner and in a manner that continuously relieves and increases rolling force in direct offsetting relation to the roll eccentricities. And this is done simultaneously with, but independently of, control of the freezing front of the metal.

More particularly, the invention continuously measures rolling force 8 (in FIG. 1), which is the force at which solid metal separates the rolls of the casting machine, and develops therefrom a value that is fed back, as indicated by line 18, to means 20 that compensates for eccentricity by adjusting the roll gap in synchronism with measured changes in force (ΔF). (Rolling force is measured by a suitable transducer or load cell device (not shown) appropriately located to receive the load at which solid metal is rolled in the gap of the rolls.) The changing forces on the metal due to roll eccentricity are sampled an appropriate number of times during one complete revolution of each roll to indicate the rotational position of eccentricity. The sampling takes place within the computer and is not otherwise indicated in the drawings. Means 20 signals the roll position actuators that control the size of the roll gap in accordance with the rotational position of the rolls, i.e., as the larger diameter of the eccentric roll moves into the solid metal product in the roll gap, the screw or cylinder is operated to move the rolls apart and thereby increase gap size. As the large diameter of the roll rotates out of the solid metal and the roll's small diameter moves toward the metal, the screws or cylinders move one roll, on orders from 20, toward the other to decrease gap size. In this manner, a solid metal product having a constant gauge issues from the rolls, this being desired by both the manufacturer and customer. In this manner, freeze front control is prevented from enhancing the effects of eccentricity. This is effected by continuously adjusting the actuators that control the size of the roll gap in response to the output of 20.

As mentioned earlier, an eccentricity control scheme that can be employed at 20 is disclosed in U.S. Pat. No. 4,222,254 to King et al.

In the King et al. patent, Fourier transform processing is employed to separate variations in thickness and/or hardness of a material entering a rolling mill from the effects of roll eccentricity, both of which effect the gauge (Δh) of the material leaving the mill. The patented method involves the steps of estimating the cyclic effects of eccentricity on exit gauge while simultaneously correcting for the adverse effects of incoming gauge and/or hardness variations.

In the present case, starting with caster 10 operating in a steady-state manner, the above equation (1) applies. The ΔS in equations 3 and 4 below, represents deviations in roll gap that are due to both gap actuator motion and eccentricities. This can be expressed as follows:

$$\Delta S(t)=\Delta Se(t)+\Delta Sa(t) \tag{3}$$

$$\Delta h(t) = \Delta Se(t) + \Delta Sa(t) + \frac{\Delta F(t)}{M} \tag{4}$$

with Se representing eccentricity and Sa representing actuator motion.

The eccentricity compensation calculated at 20 employs an algorithm that produces gap actuator movement, which can be expressed mathematically as follows:

$$\Delta Se = -\Delta Sa \tag{5}$$

and, by exchanging the terms of equation (5) for those in equations (3), equation $$\Delta S=(-\Delta Se+\Delta Se=0 \tag{6}$$

is produced. Now, if equation (6) is combined with equation (1), the equation $$\Delta h=\Delta F/M \tag{7}$$

is provided, i.e., any change in the gauge Δh of the metal exiting caster 10 reflects on changes occurring on rolling force ΔF divided by stretch modulus M of the caster housing.

However, with the freeze front control effected at 17, as described above, ΔF is zero. And, there are no steady-state gauge deviations (Δh) because, by substituting zero for ΔF in equation (7), gauge (h) is constant.

In attempting to integrate freeze front control and eccentricity compensation, it was found there was a shift in phase between the occurrences of the eccentricity disturbance and the force measurement. This shift can be as large as 90 degrees when motor current is employed for freeze front control. The discovery of this phenomenon, and the correction therefor, as presently to be discussed, made possible the successful integration disclosed herein.

As shown by box 21 in FIG. 1 of the drawings, such a condition can be compensated for. An appropriate procedure involves a simple appropriate shift of the output buffer of the computer handling the Fourier transform. This will compensate for the delays occurring in load cell output and actuator response such that the command signal finally employed to offset eccentricity is correctly timed.

In FIG. 2 of the drawings, a procedure is depicted that utilizes rolling force instead of motor current to control the position of the freezing front of molten metal in the roll bite. Rolling force, as in the process of FIG. 1, is also employed to control the effects of roll eccentricity. The same reference numerals are used for like components in the two figures.

In FIG. 2 then, a value representing the force or load at which solid metal is currently being rolled is continuously measured and fed back to a summing junction 24, as indicated by line 26. Junction 24 also receives a force reference value 23 from operating personnel for comparing with the actual force being measured. Junction 24 compares the reference value to the force value 8 to provide a force error 25 that is employed by controller 16, as in FIG. 1, to maintain the proper position of the freeze front in the roll bite. In this case the algorithm employed by the controller uses rolling force, as opposed to motor current. The reference and measured force values are of opposite polarity, as in FIG. 1, such that any difference occurring between the two is continuously noted and the controller automatically appropriately instructed to change the rotational velocity of the casting rolls.

The same force value directed to junction 24 is also sampled and directed to means 20 for compensating for roll eccentricity in a manner already explained. Hence, the precise positioning of the freeze front is effected in the processes of FIG. 2 without enhancing the effects of eccentricity, and the eccentricity component of the casting process is itself compensated for such that the gauge of the product exiting the casting machine 10 is constant.

FIG. 3 of the drawings shows a process in which the gauge of the product exiting the casting process 10 is the parameter measured and then employed to effect eccentricity compensation, and also employed to control nominal strip thickness while motor current is employed separately and simultaneously to position the freeze front of the metal in the entry bite of the rolls.

In the processes of FIG. 3, the gauge 9 of the product leaving casting process 10 is measured by a suitable thickness indicating means, such as an X-ray gauge or a beta gauge (using a radioactive source). A value is developed therefrom that represents the product gauge. This value is fed back to means 20, as indicated by line 28, for eccentricity compensation, as explained above in connection with FIGS. 1 and 2. The value is also directed to a summing junction 30. Junction 30 receives also a gauge reference 31 from (again) operating personnel which, in turn, provides a gauge error 32 when the measured gauge is different from the reference gauge.

Preferably, a standard proportional-integral type controller 33 is employed to receive the gauge error from 30 and thereby provides a gap position reference 34 for dynamic control of the gap setting actuators of the casting rolls. The relative positions of the rolls are thereby set to provide a roll gap that establishes automatically the nominal product gauge (automatic gauge control) set by gap reference 34. Since the combination of freeze front control and eccentricity compensation has been described herein as sufficient for reducing gauge variations (Δh) to substantially zero, the most significant contribution of automatic gauge control now is to establish the correct nominal thickness in the delivered product. Nominal control cares for those deviations in thicknesses that are not due to the eccentricities of the caster rolls.

The output of controller 33 is, however, first combined at a junction 35 with the output of the eccentricity and phase compensation controls of 20 and 21. In this manner, a total gap position reference 36 ensures precise compensation for roll eccentricity in the manner described earlier.

In the meantime, motor current 7 is shown measured in FIG. 3 and its value fed back to junction 14 (as in FIG. 1) to provide position control of the freeze front simultaneously with, but independent of automatic gauge control (AGC) and eccentricity compensation. (In FIG. 3, the components and values that are common with those of FIG. 1 have the same numerals.) Similarly, the processes of FIG. 3 can use a rolling force measurement, instead of motor current, to provide simultaneous freeze front control in combination with automatic gauge control and eccentricity compensation. Since eccentricity compensation (again) is separate from freeze front control and functions to relieve the otherwise constant rolling force ordinarily provided by freeze front control, the effects of eccentricity are not only not enhanced but are in fact removed from the rolling process such that a metal product issues from 10 that is free from the effects of eccentricity. In addition, the automatic gauge control function assures correct nominal thickness of the product issuing from 10.

While the invention has been described in terms of preferred embodiments, the claims appended hereto are intended to encompass all embodiments which fall within the spirit of the invention.

What is claimed is:

1. An integrated process for automatically controlling the position of solidification of molten metal in the bite of rotating rolls of roll casting apparatus, and compensating for roll eccentricity, without coupling of the two efforts, the process comprising the steps of:

rotating the rolls, supplying molten metal to the bite of the rolls, solidifying the metal in said bite and directing the same through a gap provided between the rolls, measuring a casting parameter and providing therefrom a time based value representing the actual position of metal solidification in the roll bite, providing a reference value of said parameter, obtaining a value representative of any difference occurring between the reference and solidification position values, and utilizing the same to properly position solidification, estimating from a time based casting parameter the frequency of the eccentricity of the rolls, and developing therefrom a frequency based eccentricity value, and utilizing the frequency based eccentricity value to cyclically change the size of gap between the rolls to offset the effects of eccentricity on the gauge of solid metal exiting the rolls without influencing the ability to control the position of solidification in the roll bite.

2. The process of claim 1 in which the parameter employed for determining the position of solidification is the current of a motor driving the casting rolls.

3. The process of claim 1 in which the frequency component representing eccentricity is obtained from a measurement of the force at which solid metal separates the casting rolls.

4. The process of claim 3 wherein the force at which solid metal separates the rolls is the parameter indicative of the position of solidification, as well as providing the frequency component representing roll eccentricity.

5. An integrated process for automatically controlling (1) the position of solidification of molten metal in the bite of rotating rolls of roll casting apparatus, (2) the gauge of solid metal exiting the casting apparatus, and (3) compensation for roll eccentricity, the process comprising the steps of:

rotating the rolls, supplying molten metal to the bite of the rolls, solidifying the metal in the bite and directing the same through a gap provided between the rolls, measuring a time based casting parameter and providing therefrom a value representative thereof, providing a reference value of said parameter, noting any difference occurring between the measured and reference values, and utilizing the same to properly locate the position of solidification in the roll bite, estimating the frequency of the eccentricity of the rolls from a time based casting parameter, and developing therefrom a frequency based eccentricity value, utilizing the eccentricity value to cyclically change the size of the gap between the rolls to offset the effects of eccentricity on the gauge of solid metal exiting the rolls, measuring the gauge of the product exiting the roll gap and providing therefrom a time based value indicative of exit gauge, providing a reference value for gauge, obtaining a value representative of any difference occurring between the reference and measured gauge values, and utilizing the same to control the size of the roll gap without affecting the ability to control the effects of roll eccentricity on the gauge of the metal being cast.

6. An integrated process for automatically controlling the gauge of a solid metal product exiting a gap provided between opposed rolls of roll casting apparatus, and automatically compensating for roll eccentrically, without coupling of the two efforts, the process comprising the steps of:

rotating the rolls, supplying molten metal to the bite of the rolls, measuring the gauge of the product exiting the roll gap and providing therefrom a time based value indicative of exit gauge, providing a reference value for gauge, obtaining a value representative of any difference occurring between the reference and measured gauge values, utilizing the same to control the size of the roll gap, estimating from a time based casting parameter the frequency of the eccentricity of the rolls, developing therefrom a frequency based eccentricity value, and utilizing the same to cyclically change the size of the roll gap to offset the effects of eccentricity on the gauge of the product exiting the rolls without affecting the ability to control the gauge of solid metal exiting the roll gap.

7. The process of claim 6 including the additional steps of:

measuring a casting parameter that is indicative of the position of metal solidification in the bite of the rolls, and developing therefrom a value of said position, providing a reference value of said parameter, obtaining a value representative of any difference occurring between the reference and measured position values, and utilizing the same to properly locate the position of solidification.

8. The process of claim 7 in which the casting parameter is the electrical current pulled by a motor that rotates the rolls of the casting apparatus.

9. The process of claim 7 in which the casting parameter is the force at which solid metal separates the rolls of the casting apparatus.

* * * * *